US010024039B2

(12) United States Patent
Cheng

(10) Patent No.: US 10,024,039 B2
(45) Date of Patent: Jul. 17, 2018

(54) DRAIN STRAINER

(71) Applicant: Hsi-Min Cheng, Taichung (TW)

(72) Inventor: Hsi-Min Cheng, Taichung (TW)

( * ) Notice: Subject to any disclaimer, the term of this patent is extended or adjusted under 35 U.S.C. 154(b) by 812 days.

(21) Appl. No.: 14/251,873

(22) Filed: Apr. 14, 2014

(65) Prior Publication Data

US 2015/0292191 A1 Oct. 15, 2015

(51) Int. Cl.
*E03C 1/264* (2006.01)

(52) U.S. Cl.
CPC ..... *E03C 1/264* (2013.01)

(58) Field of Classification Search
None
See application file for complete search history.

(56) References Cited

U.S. PATENT DOCUMENTS 6,108,828 A * 8/2000 Cheng ..... A47K 1/14 4/286
8,496,811 B2 * 7/2013 Cohen ..... E03F 5/041 210/163
8,628,657 B1 1/2014 Robillard et al.
2004/0073992 A1 * 4/2004 Saman ..... E03C 1/262 4/287
2008/0295236 A1 * 12/2008 Eichler ..... E03C 1/264 4/292
2011/0240536 A1 * 10/2011 Tseng ..... E03F 5/042 210/136
2012/0199215 A1 * 8/2012 Cohen ..... E03F 5/041 137/362
2015/0292191 A1 * 10/2015 Cheng ..... E03C 1/264 210/153

FOREIGN PATENT DOCUMENTS

DE 102004048992 A1 4/2006

* cited by examiner

*Primary Examiner* — Robert James Popovics
(74) *Attorney, Agent, or Firm* — patenttm.us

(57) ABSTRACT

A drain strainer includes a base, a drain plate and a cover. The base includes a drainpipe, a surrounding wall located over the drainpipe, and a connecting portion horizontally connected with the drainpipe and the surrounding wall. The drain plate is mounted in the base and includes a rod recess formed at a center of the drain plate and multiple drainage holes formed through the drain plate. The cover is mounted in the rod recess of the drain plate. The drain strainer can decorate the interior of the kitchen or the bathroom, and is able to filter away dirt or hair easily.

12 Claims, 9 Drawing Sheets

DRAIN STRAINER

BACKGROUND OF THE INVENTION

1. Field of the Invention

The present invention relates to a plumbing device installed in a building, and more particularly relates to a drain strainer.

2. Description of Related Art

The conventional drain strainer is usually installed above a drainpipe and filters out dirt or hair to prevent the dirt or hair from falling into the drainpipe. The drain strainer has a drain plate having multiple drain holes for filtering out dirt or hair.

The drain plate is usually mounted in the floor of a kitchen or bathroom. The drain plate and the drain holes are exposed out of the floor and make the interior decoration of the kitchen or bathroom less aesthetically appealing.

To overcome the shortcomings of the conventional drain strainer, the present invention provides a drain strainer to mitigate or obviate the aforementioned problems.

SUMMARY OF THE INVENTION

The main objective of the invention is to provide a drain strainer including a base, a drain plate and a cover. The base includes a drainpipe, a surrounding wall located over the drainpipe, and a connecting portion horizontally connected with the drainpipe and the surrounding wall. The drain plate is mounted in the base and includes a rod recess formed at a center of the drain plate and multiple drainage holes formed through the drain plate. The cover is mounted in the rod recess of the drain plate.

Other objects, advantages, and novel features of the invention will become more apparent from the following detailed description when taken in conjunction with the accompanying drawing.

DETAILED DESCRIPTION OF PREFERRED EMBODIMENT

Figure 1:
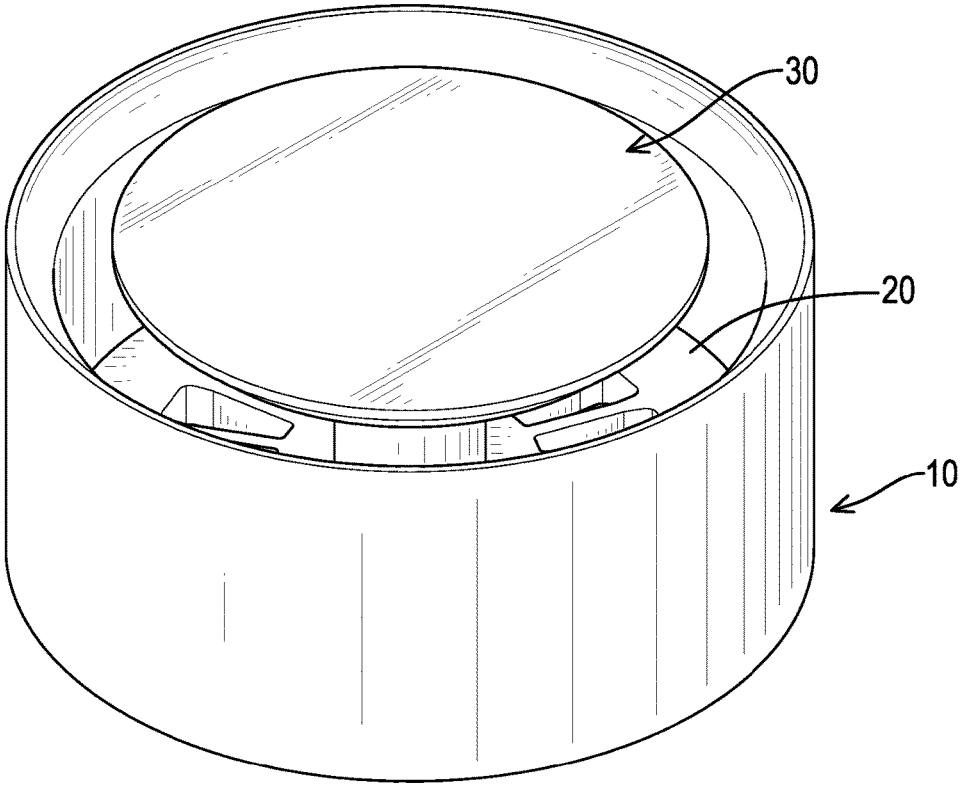
FIG. 1 is a perspective view of a drain strainer in accordance with the present invention.
Figure 2:
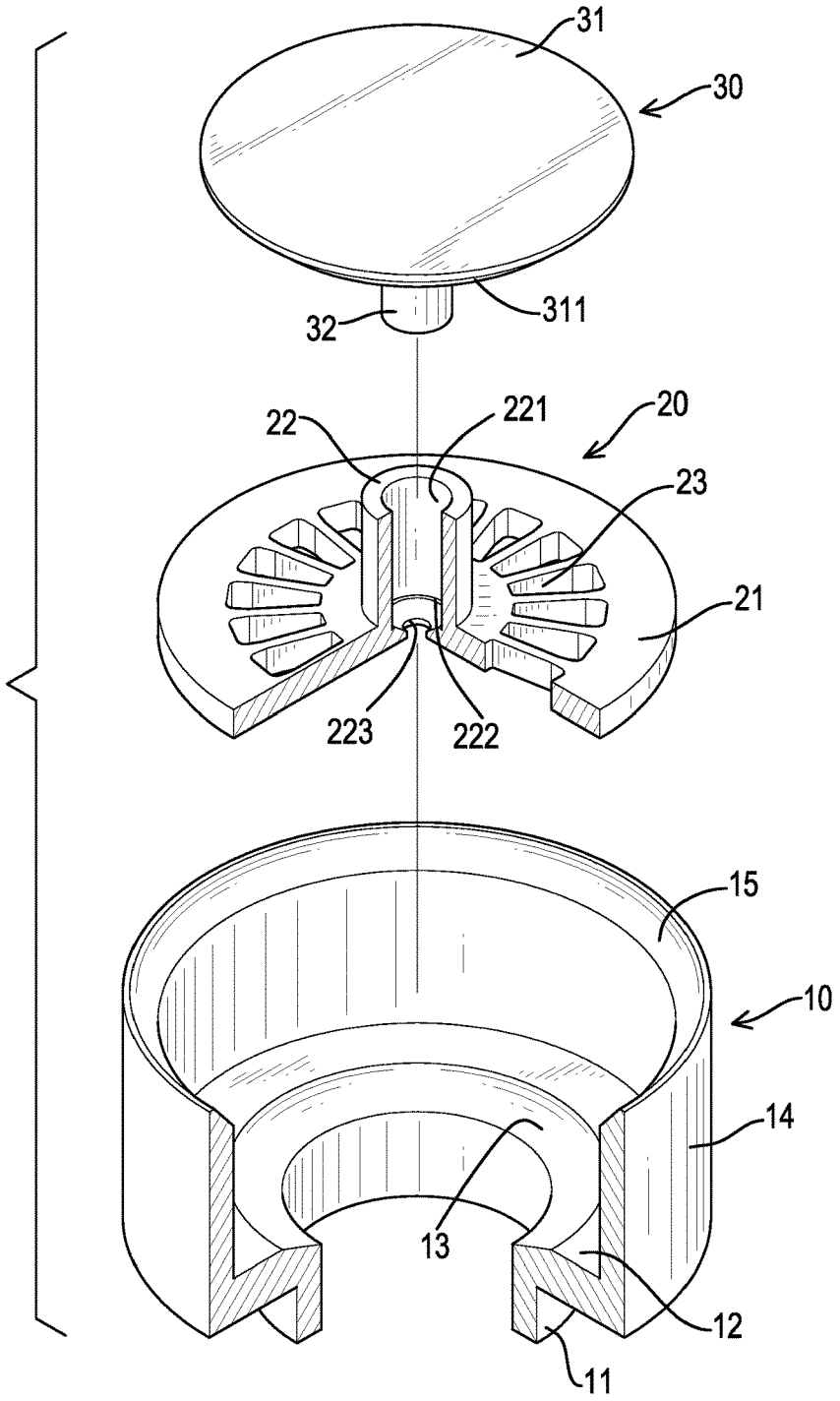
FIG. 2 is an exploded perspective view of the drain strainer in FIG. 1.

With reference to FIGS. 1 and 2, a first preferred embodiment of a drain strainer in accordance with the present invention may be made of stainless steel or aluminum or other materials. The first embodiment is made of stainless steel and has a base 10, a drain plate 20 and a cover 30.

With reference to FIGS. 1 and 2, the base 10 includes a drainpipe 11, a connecting portion 12, a guiding surface 13, a surrounding wall 14, and a sloped surface 15. The drainpipe 11 has a top end and a diameter. The connecting portion 12 is horizontally formed around the top end of the drainpipe 11 and has an inner surface and an outer edge. The guiding surface 13 is formed at the inner surface of the connecting portion 12, is sloped, and has a lower inner portion and a higher outer portion. The surrounding wall 14 is formed around the outer edge of the connecting portion 12 and has an inner diameter and an inner edge. The inner diameter of the surrounding wall 14 is bigger than the diameter of the drainpipe 11. The sloped surface 15 is formed around the inner edge of the surrounding wall 14 and has a lower inner portion and a higher outer portion.

Figure 3:
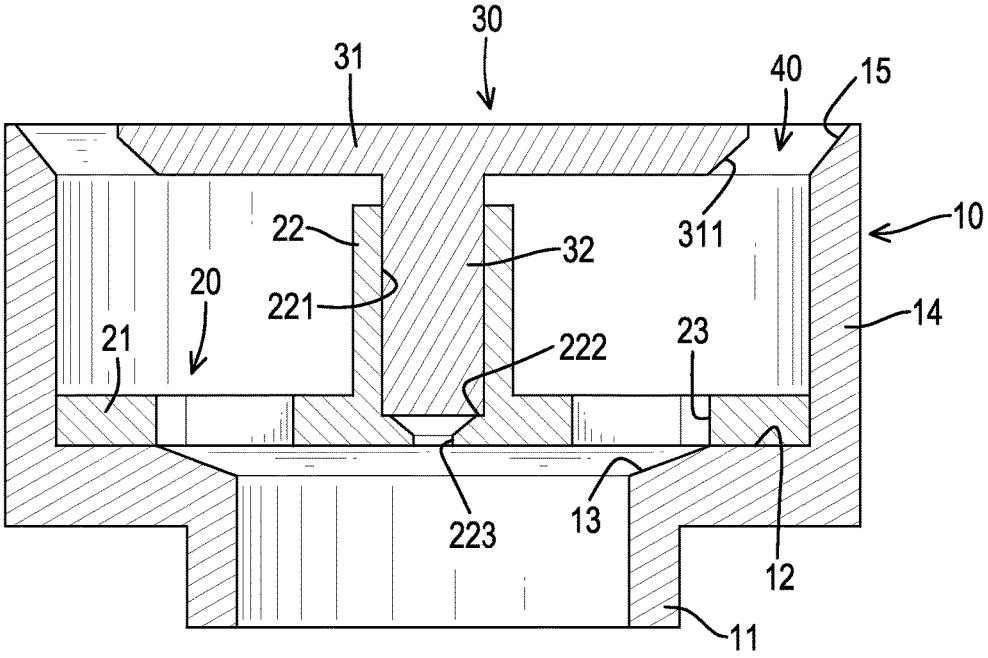
FIG. 3 is a cross-sectional front view of the drain strainer in FIG. 1.

With reference to FIGS. 2 and 3, the drain plate 20 is mounted in the base 10 and includes a base plate 21, a sleeve tube 22, and multiple drainage holes 23. The base plate 21 is circular, is mounted in the connecting portion 12, and has a diameter equal to the inner diameter of the surrounding wall 14. The sleeve tube 22 protrudes from a center of the base plate 21 and has a rod recess 221, an air hole 222, and a sloped surface 223. The rod recess 221 is formed at a center of the sleeve tube 22 and has a bottom and an opening formed in a top of the rod recess. The air hole 222 is formed through the bottom of the rod recess 221. The sloped surface 223 of the sleeve tube 22 is formed around the air hole 222, and an inner edge of the sloped surface 223 of the sleeve tube 22 is lower than an outer edge of the sloped surface 223 of the sleeve tube 22. The drainage holes 23 are formed through the base plate 21 and are radially arranged and communicate with the drainpipe 11.

With reference to FIGS. 2 and 3, the cover 30 is mounted on the drain plate 20 and includes a cover board 31 and a cover rod 32. The cover board 31 is round and has an outer edge, a top face, a bottom face, a diameter, and a guiding face 311. The diameter of the cover board 31 is smaller than the inner diameter of the surrounding wall 14. The guiding face 311 is formed around the outer edge of the cover board 31, is sloped, and corresponds to the sloped surface 15 of the base 10.

The cover rod 32 is detachable from the cover board 31 and has a top end and a bottom end. The top end of the cover rod 32 is mounted on a center of the bottom face of the cover board 31. The bottom end of the cover rod 32 is inserted into the rod recess 221, and the top surface of the cover 30 is flush with a top end of the base 10.

An inlet 40 is annular and is formed between the guiding face 311 and the sloped surface 15 of the base 10.

Figure 4:
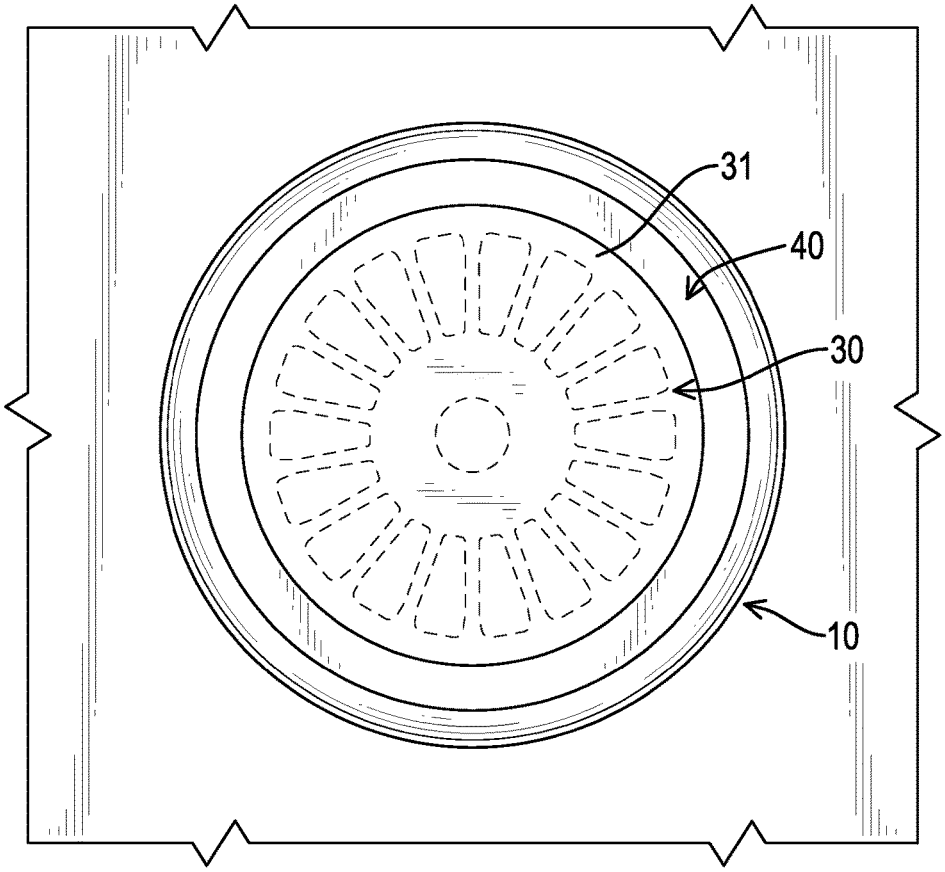
FIG. 4 is a top view of the drain strainer in FIG. 1, shown mounted in the floor.
Figure 5:
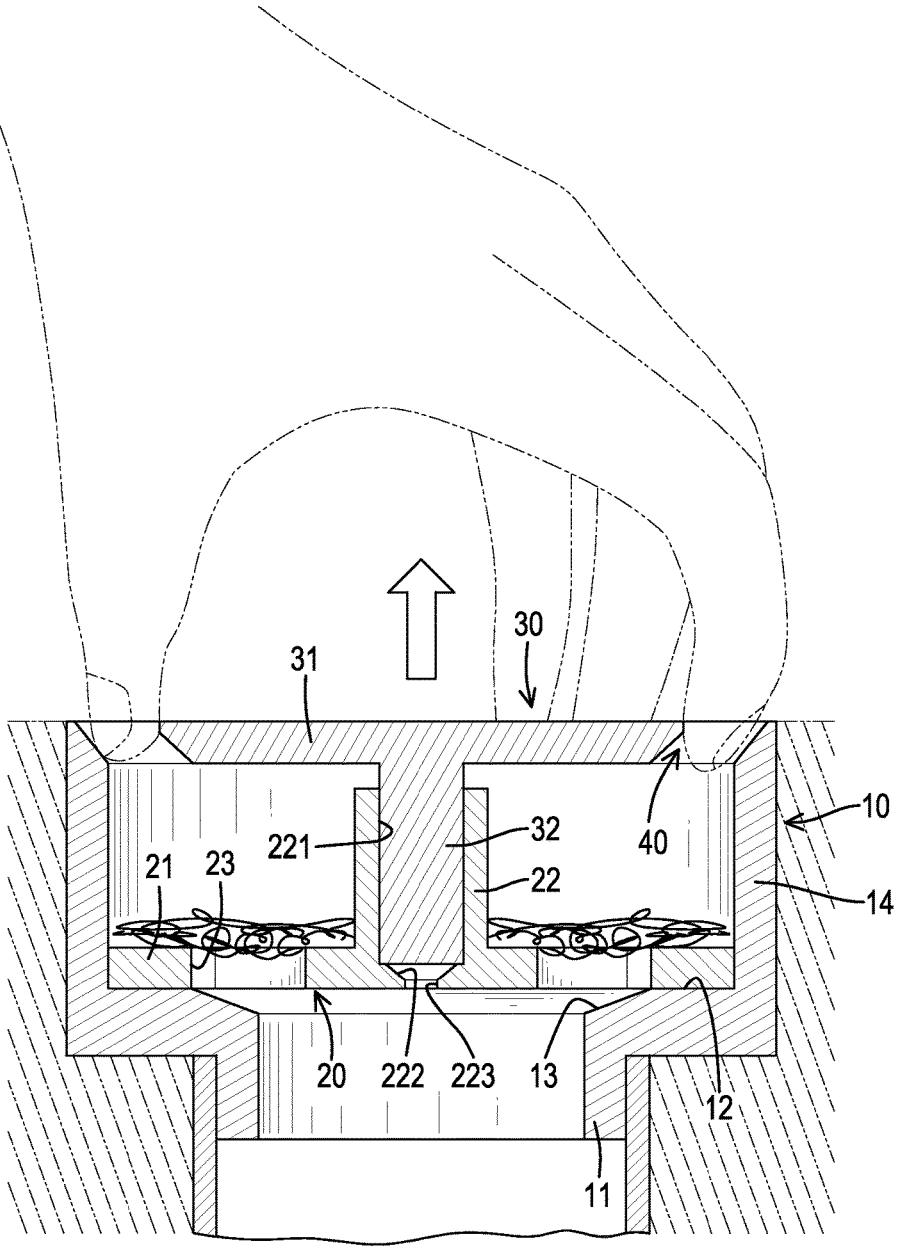
FIG. 5 is an operational side view in partial section of the drain strainer in FIG. 3, shown mounted in the floor.

With reference to FIGS. 4 and 5, the base 10 is mounted in a floor. The top surface of the cover 30 is flush with the floor and can be made by a material same as that of the floor. All the drainage holes 23 are covered by the cover 30. Accordingly, only the narrow, annular inlet 40 is exposed, so the present invention can decorate the interior of the kitchen or the bathroom well and make the appearance appealing.

Figure 6:
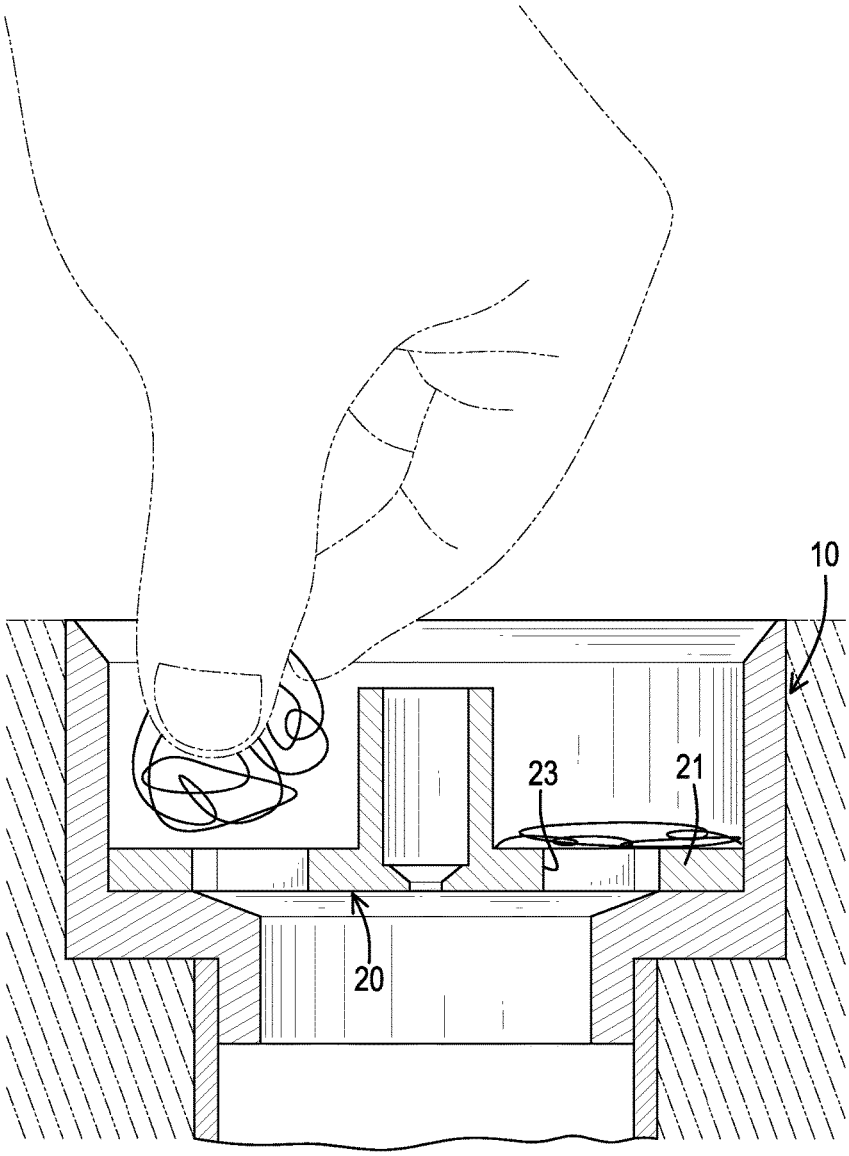
FIG. 6 is an operational side view in partial section of the drain strainer in FIG. 5, showing a user cleaning out hair from the drain strainer.

With reference to FIGS. 5 and 6, when the drain strainer is in use, the water flows into the inlet 40, and then flows through the drainage holes 23 into the drainpipe 11, and is drained out via the drainpipe 11. After the water flows through the drain plate 20, hair or dirt is blocked and remains on the drain plate 20. A user can insert his fingers into the inlet 40 and grab the cover 30 to lift up the cover 30, and clean up the hair easily and directly.

Figure 7:
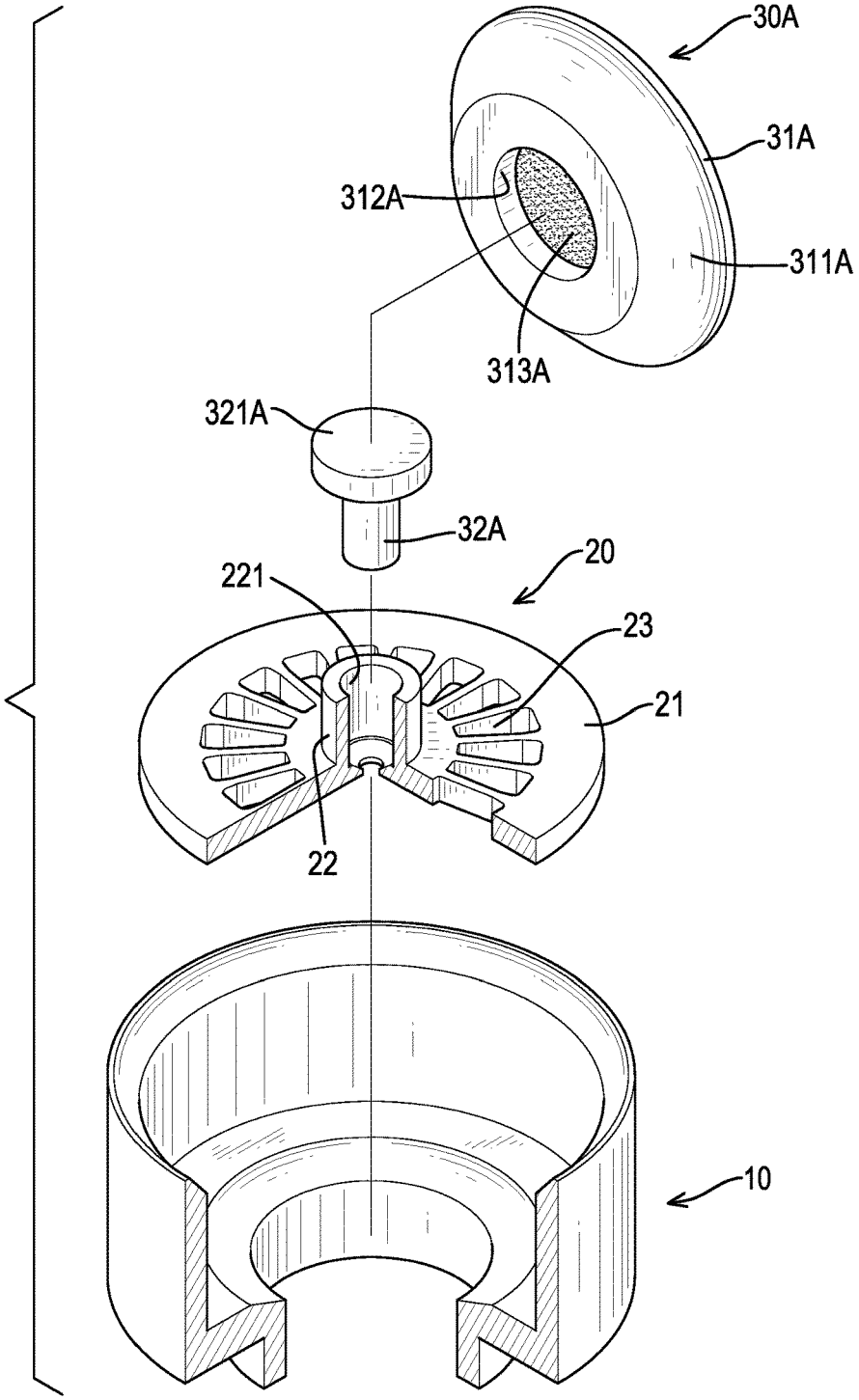
FIG. 7 is an exploded perspective view of a second embodiment of the drain strainer in accordance with the present invention.
Figure 8:
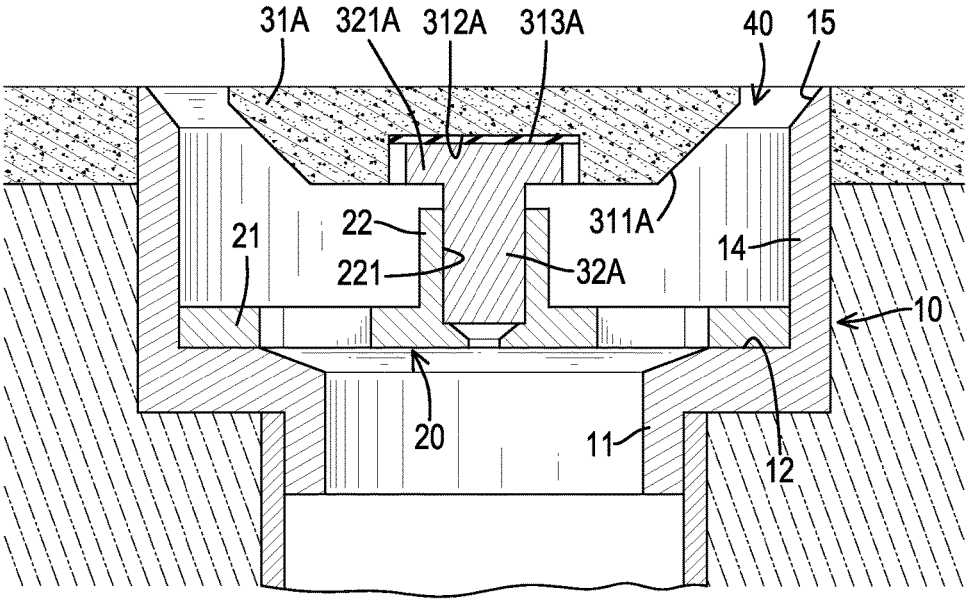
FIG. 8 is a cross-sectional front view of the drain strainer in FIG. 7.

With reference to FIGS. 7 and 8, in a second embodiment of the drain strainer in accordance with the present invention, the elements and effects of the second embodiment are same as those of the first embodiment except for the cover 30A.

The cover 30A includes a cover board 31A and a cover rod 32A. The cover board 31A is made of marble and has a guiding face 311A, a mounting recess 312A, and a glue layer 313A. The guiding face 311A is formed around the outer edge of the cover board 31A. The mounting recess 312A is formed in the bottom face of the cover board 31A. The glue layer 313A is mounted in a top inner face of the mounting recess 312A.

The cover rod 32A has a head 321A mounted in the mounting recess 312A and is attached firmly on the glue layer 313. The cover rod 32A of the cover 30A is mounted in the sleeve tube 22

Figure 9:
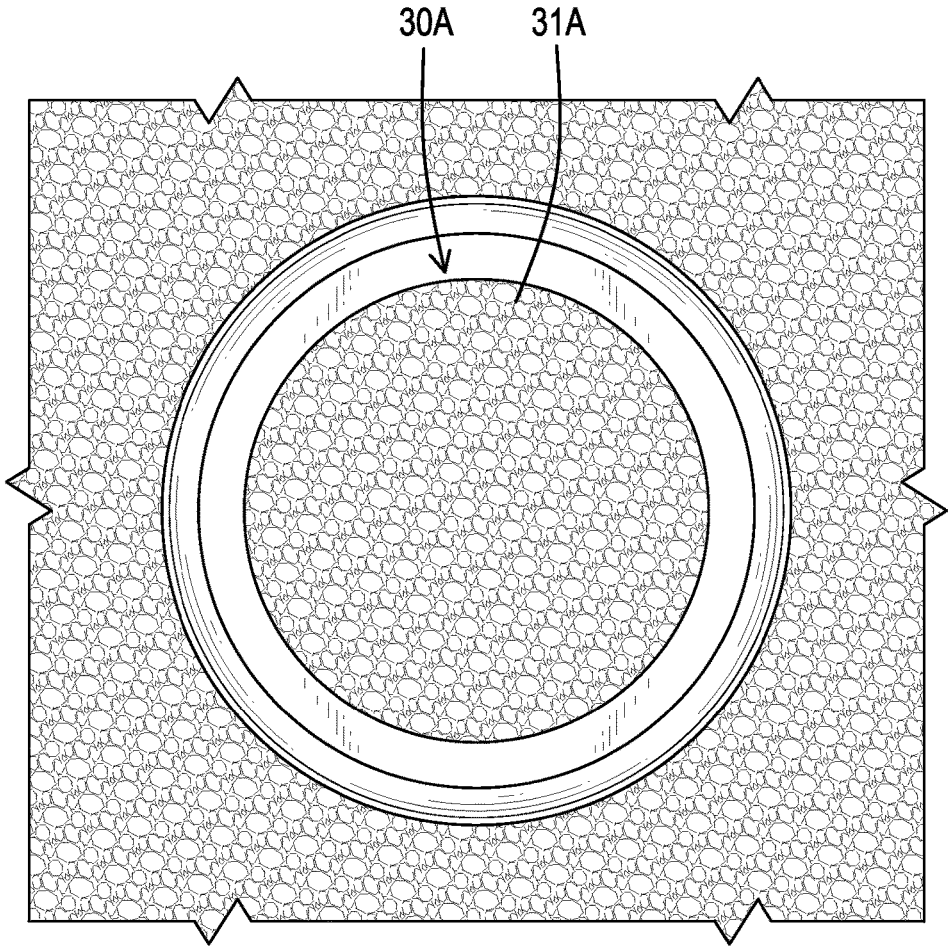
FIG. 9 is a top view of the drain strainer in FIG. 7, shown mounted in the floor.

With reference to FIG. 9, the drain strainer of the present invention is mounted in a marble floor, and the cover 30A is also made of marble, so the style of the drain strainer corresponds to and has consistency with the marble floor and improves the overall floor appearance.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drain strainer comprising:

a base including a drainpipe;

a surrounding wall located over the drainpipe and having an inner diameter; and a connecting portion horizontally connected with the drainpipe and the surrounding wall;

a drain plate mounted in the base and including a rod recess formed at a center of the drain plate; and multiple drainage holes formed on a surface of the drain plate; and a cover mounted on the drain plate, a top surface of the cover being flush with a top end of the base, and the cover including a cover board having a bottom face and a diameter, the diameter of the cover board being smaller than the inner diameter of the surrounding wall;

a cover rod having a top end and a bottom end, the top end of the cover rod connected with the bottom face, and the bottom end of the cover rod inserted into the rod recess; and an inlet being annular and formed between the cover board and the base.

2. The drain strainer as claimed in claim 1, wherein the drainpipe has a top end and a diameter;

the connecting portion is formed around the top end of the drainpipe and has an outer edge; and the surrounding wall is formed around the outer edge of the connecting portion, and the inner diameter of the surrounding wall is bigger than the diameter of the drainpipe.

3. The drain strainer as claimed in claim 2, wherein the surrounding wall has an inner edge, and a sloped surface is formed around the inner edge of the surrounding wall.

4. The drain strainer as claimed in claim 3, wherein the connecting portion has an inner surface, and a guiding surface is formed at the inner surface of the connecting portion.

5. The drain strainer as claimed in claim 4, wherein the drain plate includes a sleeve tube protruding from the center of the drain plate;

the sleeve tube has an air hole formed through a bottom of the rod recess, and a sloped surface is formed around the air hole; and the rod recess is formed at a center of the sleeve tube.

6. The drain strainer as claimed in claim 1, wherein the drain plate includes a sleeve tube protruding from the center of the drain plate;

the sleeve tube has an air hole formed through a bottom of the rod recess, and a sloped surface is formed around the air hole; and the rod recess is formed at a center of the sleeve tube.

7. The drain strainer as claimed in claim 1, wherein the cover board has an outer edge and a guiding face formed around the outer edge of the cover board.

8. The drain strainer as claimed in claim 2, wherein the cover board has an outer edge and a guiding face formed around the outer edge of the cover board.

9. The drain strainer as claimed in claim 3, wherein the cover board has an outer edge and a guiding face formed around the outer edge of the cover board.

10. The drain strainer as claimed in claim 4, wherein the cover board has an outer edge and a guiding face formed around the outer edge of the cover board.

11. The drain strainer as claimed in claim 5, wherein the cover board has an outer edge and a guiding face formed around the outer edge of the cover board.

12. The drain strainer as claimed in claim 6, wherein the cover board has an outer edge and a guiding face formed around the outer edge of the cover board.

* * * * *